US011814937B2

(12) United States Patent
AlSaud et al.

(10) Patent No.: US 11,814,937 B2
(45) Date of Patent: Nov. 14, 2023

(54) METHODOLOGY FOR MODELING ELECTROKINETIC EFFECTS AND IDENTIFYING CARBONATED WATER INJECTION PARAMETERS

(71) Applicant: SAUDI ARABIAN OIL COMPANY, Dhahran (SA)

(72) Inventors: Moataz Abu AlSaud, Khobar (SA); Subhash Ayirala, Dhahran (SA); Ali Yousef, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/208,195

(22) Filed: Mar. 22, 2021

(65) Prior Publication Data

US 2022/0298901 A1 Sep. 22, 2022

(51) Int. Cl.

| | |
|---|---|
| ***E21B 43/16*** | (2006.01) |
| ***E21B 49/08*** | (2006.01) |
| ***E21B 47/07*** | (2012.01) |

(52) U.S. Cl.

CPC ..... *E21B 43/164* (2013.01); *E21B 47/07* (2020.05); *E21B 49/0875* (2020.05); *E21B 2200/20* (2020.05)

(58) Field of Classification Search

CPC ..... E21B 43/24; E21B 43/16; E21B 43/2401; E21B 36/04; E21B 43/243; E21B 47/07;

(Continued)

(56) References Cited

U.S. PATENT DOCUMENTS

| | | | |
|---|---|---|---|
| 3,800,874 | A | 4/1974 | Kern |
| 9,316,096 | B2 | 4/2016 | Bang et al. |

(Continued)

FOREIGN PATENT DOCUMENTS

| | | | |
|---|---|---|---|
| CA | 2096118 | C | 6/1995 |
| CA | 2725322 | C | 5/2016 |

(Continued)

OTHER PUBLICATIONS

Awolayo, Adedapo Noah et al., "Numerical Modeling of Fluid-Rock Interactions During Low-Salinity-Brine-CO2 Flooding in Carbonate Reservoirs", SPE-193815-MS, Society of Petroleum Engineers, Apr. 2019, pp. 1-25 (25 pages).

(Continued)

*Primary Examiner* — Zakiya W Bates

(74) *Attorney, Agent, or Firm* — Osha Bergman Watanabe & Burton LLP

(57) ABSTRACT

A method for recovering hydrocarbons from a hydrocarbon-containing formation. The method may include determining the hydrocarbon-containing formation pressure, temperature, and other properties such as the total acid number and total base number of the hydrocarbons, rock type, and brine ionic composition. The method may also include determining a desired amount of wettability alteration of the formation and modeling the formation. Modeling the formation may be based on the determined pressure, temperature, total acid number and total base number of the hydrocarbons, rock type, and brine ionic composition. The method may also include preparing an aqueous wellbore fluid based on the estimated wellbore fluid composition and injecting the aqueous wellbore fluid into the hydrocarbon-containing formation.

8 Claims, 6 Drawing Sheets

(58) Field of Classification Search
CPC .... E21B 47/06; G01V 99/005; G01N 24/081; G01N 33/24
See application file for complete search history.

(56) References Cited

U.S. PATENT DOCUMENTS

| | | | | |
|---|---|---|---|---|
| 10,000,687 | B2 | 6/2018 | Al-Yousef et al. | |
| 10,287,486 | B2 | 5/2019 | Ayirala et al. | |
| 2018/0291717 | A1 | 10/2018 | Ayirala et al. | |
| 2019/0128791 | A1* | 5/2019 | McCarty | C09K 8/88 |
| 2019/0233712 | A1 | 8/2019 | Fathi Najafabadi et al. | |

FOREIGN PATENT DOCUMENTS

| | | | |
|---|---|---|---|
| EP | 2596208 | B1 | 10/2016 |
| WO | 2010139932 | A2 | 12/2010 |
| WO | 2016105395 | A1 | 6/2016 |

OTHER PUBLICATIONS

Bonto, Maria et al., "An overview of the oil-brine interfacial behavior and a new surface complexation model", Scientific Reports, The Authors, Apr. 2019, pp. 1-16 (16 pages).
Chen, Yongqiang et al., "Insights into the wettability alteration of CO2-assisted EOR in carbonate reservoirs", Journal of Molecular Liquids, ScienceDirect, Elsevier B.V., vol. 279, Jan. 2019, pp. 420-426 (7 pages).
Foroozesh, Jalal and Mahmoud Jamiolahmady, "Simulation of carbonated water injection coreflood experiments: An insight into the wettability effect", Fuel, ScienceDirect, Elsevier Ltd., vol. 184, Jul. 2016, pp. 581-589 (9 pages).
Korrani, Aboulghasem K.N. and Gary R. Jerauld, "Modeling wettability changes in sandstones and carbonates using a surface-complexation-based method", Journal of Petroleum Science and Engineering, ScienceDirect, Elsevier B.V., vol. 174, 2019, pp. 1093-1112 (20 pages).
Lee, Ji Ho and Kun Sang Lee, "Enhanced Wettability Modification and CO2 Solubility Effect by Carbonated Low Salinity Water Injection in Carbonate Reservoirs", Journal of Chemistry, Hindawi, vol. 2017, Article ID 8142032, Jul. 2017, pp. 1-10 (10 pages).
International Search Report Issued in Corresponding Application No. PCT/US2022/021136, dated Aug. 8, 2022, 6 pages.
Written Opinion Issued in Corresponding Application No. PCT/US2022/021136, dated Aug. 8, 2022, 11 pages.

* cited by examiner

METHODOLOGY FOR MODELING ELECTROKINETIC EFFECTS AND IDENTIFYING CARBONATED WATER INJECTION PARAMETERS

BACKGROUND

The efficient recovery of hydrocarbons from subterranean formations requires a detailed understanding of the relevant physicochemical processes and properties. Enhanced oil recovery (EOR) enables the extraction of hydrocarbon reserves that conventional primary and secondary recovery processes, such as gas and water displacement, cannot access. These EOR methods may be water, thermal, chemical, and gas injection processes.

Water injection is considered to be an efficient and widely used EOR method. The injection of both water and gas has revealed to have a strong impact on hydrocarbon recovery processes. EOR methods utilize the injection of carbon dioxide ($CO_2$) and water in processes such as water alternating gas (WAG) methods, carbon dioxide-foam flooding, and carbonated water injection (CWI). The use of $CO_2$ in combination with water is understood to mitigate the high mobility, and resulting poor sweep efficiency, associated with the use of $CO_2$ in continuous gas injection (CGI) processes.

Although models have been developed to understand the mechanisms involved in $CO_2$ injection as an EOR method, there are still discrepancies between experiments and simulation models for CWI process under certain operating conditions.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed relate to method for recovering hydrocarbons from a hydrocarbon-containing formation. The method may include determining the hydrocarbon-containing formation pressure, temperature, and other properties such as the total acid number and total base number of the hydrocarbons, rock type, and brine ionic composition. The method may also include determining a desired amount of wettability alteration of the formation and modeling the formation. Modeling the formation may be based on the determined pressure, temperature, total acid number and total base number of the hydrocarbons, rock type, and brine ionic composition. The method may also include preparing an aqueous wellbore fluid based on the estimated wellbore fluid composition and injecting the aqueous wellbore fluid into the hydrocarbon-containing formation.

In another aspect, embodiments disclosed relate to a method for recovering hydrocarbons from a subterranean formation. The method may include imputing one or more properties of a hydrocarbon-containing formation into a surface complexation model. The method may also include estimating, with the surface complexation model, a measured zeta potential of the hydrocarbon-containing formation based on the one or more properties input and lab-measured zeta potentials. The method may also include determining, with the surface complexation model, a calculated zeta potential of the hydrocarbon-containing formation based on equilibrium constants of a crude oil/brine surface reaction and a brine/rock surface reaction and iterating the equilibrium constants, with the surface complexation model, to determine equilibrium constants that result in the calculated zeta potential matching the measured zeta potential. The method may also include validating the surface complexation model of the hydrocarbon-containing formation being modeled. The method may also include maintaining the determined equilibrium constants and iterating an injection fluid composition to determine an injection fluid composition that provides a similar zeta potential polarity at the brine/rock interface and the crude oil/brine interface. The method may also include outputting the determined injection fluid composition, preparing an injection fluid based on the output injection fluid composition, and injecting the output injection fluid composition into the hydrocarbon-containing formation.

Other aspects and advantages of the claimed subject matter will be apparent from the following description and the appended claims.

DETAILED DESCRIPTION

Figure 1:
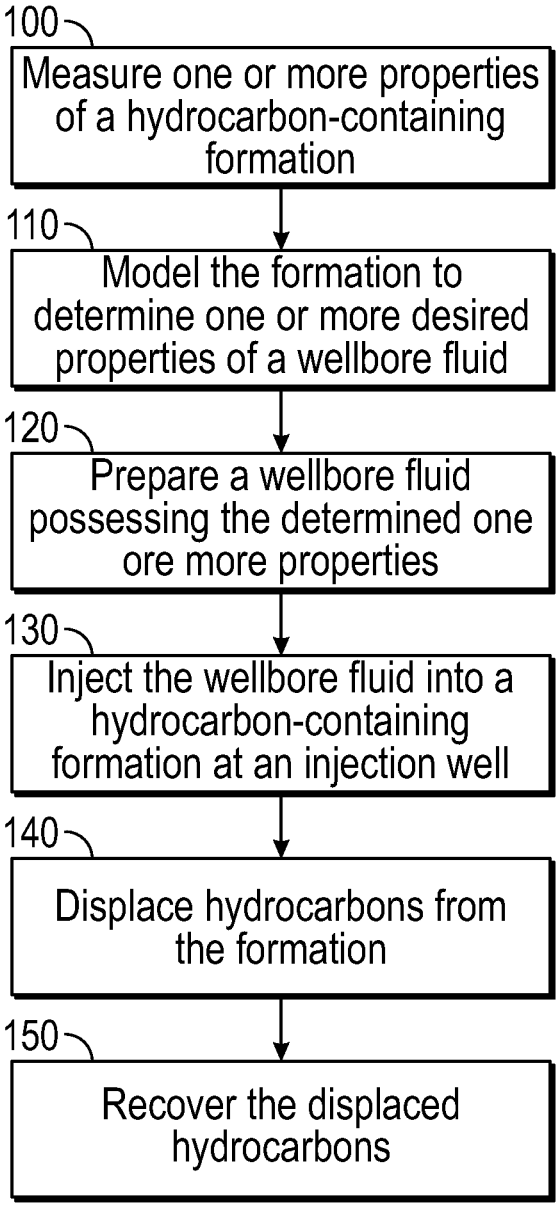
FIG. 1 is a flowchart depicting a method for recovering hydrocarbons in accordance with one or more embodiments of the present disclosure.

Embodiments in accordance with the present disclosure generally relate to methods for determining one or more optimal properties of a wellbore fluid for use in recovering hydrocarbons from a geological formation.

The methods of one or more embodiments may include recovering hydrocarbons from a hydrocarbon-containing formation, particularly via EOR methods. Whereas primary recovery is the first stage of hydrocarbon production, in which the hydrocarbons are yielded by the natural reservoir energy of the formation, and secondary recovery involves the direct replacement of hydrocarbons with a displacement fluid, such as water or gas, EOR methods improve the recovery of hydrocarbons by lowering the residual oil saturation of the formation. While hydrocarbons are referred to as crude oil herein, it will be understood by those skilled in the art that the composition of hydrocarbons may vary depending on the reservoir.

CWI is an EOR method wherein carbonated water (an amount of $CO_2$ dissolved in water under certain pressure and temperature) is injected into a reservoir via a wellbore to displace hydrocarbons in the reservoir. CWI is a combined injection method which integrates the advantages of water flooding and $CO_2$ injection.

Efficient and effective hydrocarbon (crude oil) production from a subterranean formation requires a detailed understanding of the complex physicochemical processes involved in the operation, particularly in CWI method EOR operations. In CWI, the dissolved $CO_2$ transfers to the crude oil phase to improve oil mobility and cause oil swelling, thus enhancing the sweep efficiency. These effects highly depend on the $CO_2$ solubility of the brine.

Embodiments of the present disclosure may provide for robust and accurate modeling of the complex physicochemical interactions in a CWI operation. The modeling may account for the effects of the crude oil composition as well as the reservoir pressure on the electrokinetics of interfaces of the crude oil and brine (crude oil/brine interface) and the rock mineral and brine (such as a calcite/brine interface).

The methods of one or more embodiments may include generating a simulation of the reservoir. The simulation of embodiments of the present disclosure may account for the electrokinetic effect of various parameters, such as water-salinity, reservoir pressure and temperature, and crude oil composition. Some embodiments of the present disclosure may provide insight into the mechanisms behind the wettability alteration provided by CWI through modeling simulations. The output of embodiments of the present disclosure may yield the optimal CWI fluid properties, including injection fluid chemistry and composition, for the given modelled reservoir formation. In some embodiments, the methods provide insight into the mechanisms behind the wettability alteration provided by other EOR $CO_2$ injection operations, such as water alternating gas (WAG) and $CO_2$ foam flooding.

The methods of one or more embodiments may employ a simulation methodology that accounts for the electrokinetic effect of various parameters, such as water-salinity, reservoir pressure and temperature, and crude oil composition, in determining the hydrocarbon production in a wide variety of reservoir formations, including carbonate, chalk, limestone, and sandstone formations.

Conventional studies of the physicochemical processes in CWI method of EOR may involve the modeling of a formation and fluid parameters. Low-salinity fluids used in CWI may include water, seawater, "Smart Water", NaCl, and $Na_2SO_4$. Those skilled in the art will appreciate "Smart Water" to be an injectable water fraction modified with an ion additive used in the "Smart Water flooding" technique. The increased oil recovery during low-salinity water flooding for some CWI operations is a result of the interactions between the crude oil, brine, and minerals present in the formation. Mechanisms responsible for the increased oil recovery in these CWI operations include wettability alteration, viscoelasticity of the brine/crude oil interface, interfacial tension alteration, emulsion formation, and decrease in crude oil viscosity.

CWI may alter reservoir wettability. Wettability alteration relies on the stability of the water thin-film between the reservoir rock mineral/brine and brine/crude oil interfaces. The stability of the water-thin film depends on the development of surface charges at these interfaces. The interface between crude oil and brine becomes charged due to the occurrence of acid/base interactions and adsorption reactions. The oppositely charged ions present in the brine are attracted to the water/crude oil interface, increasing the concentration at the interface. The surface charge is indirectly estimated through electrophoretic mobility studies, which may be related to the zeta potential. Optimal reservoir wettability yields optimal hydrocarbon recovery. When the charge polarity between crude oil/brine and calcite/brine interfaces are the same, either both positive or negative charges, the oil adsorption into the reservoir rock decreases. The decrease in oil adsorption into the reservoir rock facilitates the oil mobilization and may result in increased oil recovery and production.

Zeta potential measures the electrical potential at the surface of shear and indicates the adsorption and desorption of ions into the Stern layer (the first internal layer of an electric double layer). The cumulative increase in oil recovery is correlated with a cumulative normalized zeta potential, showing that a higher cumulative zeta potential leads to increased oil recovery. In cases where the crude oil/brine interface may be positively charged, the injected water composition may be selected in a way that also yields a positive zeta potential at the brine/rock mineral (e.g., calcite) interface. Identical zeta potential polarity at both interfaces leads to repulsion and improves the stability of the water film, altering the wettability towards a more water-wet state than an oil-wet state of the reservoir. The zeta potential value of a given surface is determined by the number of moles for each specific ion adsorbed on the mineral and brine surfaces. The number of moles for each adsorbed oil may be calculated using a surface complexation model (SCM).

Embodiments of the present disclosure may use zeta potentials of various exemplary fluids under a range of conditions measured and collected in laboratory environment. For example, lab-measured zeta potentials may be collected for a variety of brine compositions, including a variety of ionic compositions. The zeta potentials may also be measured and collected for a range of crude oil samples comprising low to high TAN and TBN values. Zeta potentials may also be measured in a lab and collected for a variety of temperature and pressure ranges. Lab-measured zeta potentials may also be collected for a variety of rock compositions, such as carbonate rocks.

In embodiments of the present disclosure, the lab-measured zeta potentials may be used as a basis, or an input parameter, for a range of reservoir conditions for the SCM of the present disclosure. The lab-measured zeta potentials may also be used to provide a "measured" zeta potential of a formation being modeled based on various inputs, such as rock type, formation temperature, formation pressure, TAN, and TBN, among other variables.

In embodiments of the present disclosure, the SCM may calculate sorption based on surface reaction equilibrium. Surface complexation reactions are considered fast reactions controlled by reaction thermodynamics. The number of surface sites present on a mineral in a reservoir is important in determining the sorption capacity. The surface sites of different minerals may differ significantly depending on the surface properties. Equilibrium constants in SCM describe the relationship between activities of different species. Modeling surface complexation may lead to a deeper understanding of the charged surfaces. Electric surface charges govern characteristic chemical and physical phenomena, such as ion exchange, adsorption, swelling, colloidal stability, and flow behavior. The underlying surface reaction equilibrium, and the associated rate constants associated with a formation, may also be related to the zeta potential of the formation. Embodiments herein thus utilize measured zeta potentials and calculated zeta potentials to accurately model a formation and determine injection fluid compositions that may enhance the effectiveness of EOR processes for the recovery of oil.

A method in accordance with one or more embodiments of the present disclosure is depicted by, and discussed with reference to, FIG. 1. In one or more embodiments, the method may be directed to the recovery of crude oil from a hydrocarbon-containing formation. In particular embodiments, the method may be directed to an EOR process such as chemical flooding, miscible displacement, or thermal recovery. The method of one or more embodiments may be a miscible displacement EOR process such as one of the group selected from WAG, carbon dioxide-foam flooding, and CWI.

FIG. 1 is a flowchart depicting a method for recovering hydrocarbons in accordance with one or more embodiments of the present disclosure. Specifically, in step 100, the methods of one or more embodiments may involve measuring one or more properties of the formation, also referred to as field measurements. These properties are not particularly limited and may include the mineral composition of the formation, the formation pressure, formation temperature, the brine ionic-composition (salinity), the total acid number (TAN) of the crude oil reserves, the total base number (TBN) of the crude oil reserves, the composition of the crude oil reserves, the residual oil saturation of the formation, the residual water saturation of the formation, and the like. The methods of one or more embodiments may at least involve measuring the reservoir pressure and crude oil composition in step 100, as these properties effect the electrokinetics of the brine/crude oil interface and the brine/calcite interface. The properties of one or more embodiments may be measured by any suitable method known to a person of ordinary skill in the art. For example, chemical characteristics of the formation may be determined from samples, such as rock cuttings, or by the direct measurement of the formation. The chemical characteristics of the hydrocarbon reserves, and formation water, may be determined by direct measurement of the fluids present in the formation or by measurement of samples taken from the reservoir. In some embodiments, the chemical characteristics may be determined upon an initial assessment of the formation. These measurements may be determined using standard chemical analytical techniques known to a person of ordinary skill in the art.

In some embodiments of the present disclosure, step 100 may also include estimating a value of one or more properties of the formation. Field properties may be estimated where measurements may not be possible or where information on other properties may provide enough data input to estimate a property with a reasonable degree of accuracy.

According to some embodiments of the present disclosure, the following variables may be measured and quantified, wherein the quantified values may be modeled in step 110:

(1) The specific water chemistry (for example, the ionic composition of the brine present in the formation).
(2) The crude oil composition (for example, the acid and base values).
(3) The reservoir pressure and temperature, such as based on field measurements and reservoir characterization.
(4) The surface mineralogy of the reservoir formation.

In step 100, according to some embodiments of the present disclosure, the TAN and TBN of the crude oil reserves may be quantified through laboratory measurements understood to a person of ordinary skill in the art. These laboratory measurements may include the use of infrared spectroscopy, potentiometric titration, colorimetric titration, and field test kits. In embodiments of the present disclosure, incorporating the crude oil composition for the given reservoir in the model may increase the robustness and accuracy of the SCM output, and may provide better results than assuming equal acidic and basic components.

The surface mineralogy of the reservoir formation may be a static property measured by laboratory tests understood by those skilled in the art. The mineralogy of the formation may include minerals such as calcite, and those found in sandstone. The mineralogy measurements may be determined prior to any injection treatment, such as CWI.

According to one or more embodiments of the present disclosure, zeta potentials for the reservoir formation may be estimated based on the lab-measured zeta potentials of conditions similar to that of the given reservoir formation. In other words, based on the field measurements, field estimates, or both, of the reservoir formation, a measured zeta potential may be provided as an input parameter for the SCM in step 100, wherein the measured zeta potential is based on the lab-measured zeta potentials for similar properties of the given reservoir formation. The measured zeta potential may be determined by the relationship between zeta potential and the pressure, temperature, TAN, or TBN, or a combination thereof, of the reservoir formation.

In step 110, the methods of one or more embodiments may involve modeling the values measured in step 100 to determine the optimal values of one or more properties of a wellbore fluid to yield efficient hydrocarbon recovery. The modeling operation of step 110 according to some embodiments of the present disclosure may comprise:

(1) Defining the surface reactions described by the surface complexation model for both crude oil and calcite surfaces.
(2) Determining the adsorption of brine ions saturated with $CO_2$ at the given reservoir pressure by determining the zeta potential electrokinetic parameters of the crude oil/brine and calcite/brine interfaces as provided by the surface complexation model equations.
(3) Determining the reservoir wettability for the system comprising of carbonated water/crude oil/calcite, wherein the wettability is based on the magnitude and charge polarity of the calcite/brine and crude oil/brine interfaces.

In embodiments of the present disclosure, the optimal specific water chemistry (ionic composition) of a wellbore fluid may be determined based on the measurements obtained in step 100 and modeled in step 110. In embodiments of the present disclosure, the crude oil composition (acid and base measurements), reservoir pressure, the brine ionic composition (salinity), the measured zeta potential, and surface chemistry reactions on both the mineral formation (e.g. calcite) and crude oil surfaces may be used to determine the optimal wellbore fluid that, when injected into the formation, will yield an increase in hydrocarbon recovery. It will be understood that the formation may be modeled via equations and computer programs.

As shown step 110 in FIG. 1, embodiments of the present disclosure may use the data gathered from step 100 to generate a model of the formation, including information on the physical and chemical properties of the formation. The model may be used to determine desired properties of a wellbore fluid based on the physical and chemical properties present in the formation prior to injection of the wellbore fluid. It is envisioned that these properties of the wellbore fluid will yield an increase in hydrocarbon fluid recovery. Examples of properties modeled in step 110 include the surface chemistry reactions on both the mineral formation (calcite) and crude oil surfaces. Table 1 shows exemplary surface complexation reactions and parameters for crude oil surface that may be detected in step 100 and modeled in step 110.

TABLE 1

| Crude Oil Surface Reaction | Equilibrium Constant ($\log_{30} K_{int}$) |
|---|---|
| —COOH ↔ —$COO^-$ + $H^+$ | 6 |
| —N + $H^+$ ↔ —$NH^+$ | 4 |
| —COOH + $Ca^{+2}$ ↔ —$COOCa^+$ + $H^+$ | −4 |
| —COOH + $Mg^{+2}$ ↔ —$COOMg^+$ + $H^+$ | −4.3 |
| —COOH + $Na^+$ ↔ —COONa + $H^+$ | −4 |

The equation reactions shown in the crude oil surface reaction column in Table 1 may be the same in the surface complexation models for crude oil surfaces. However, the input parameters used in the equations shown in Table 1 depend on the crude oil composition of a given formation. In a given formation as modeled using embodiments of the present disclosure, the surface reaction equations may be characterized by the TAN and TBN. The TAN number depends on the number of sites in the carboxylate group. The number of sites for a carboxylate group (—COO) increases as TAN number increases. The number of (—N) sites also increases as the base number increases. Table 2 shows an exemplary relationship of the crude oil acid and base numbers with low and high TAN according to embodiments of the present disclosure.

TABLE 2

| | Low TAN | High TAN |
|---|---|---|
| Acid number (mg KOH/g) | 0.39 | 2 |
| Base Number (mg KOH/g) | 1.86 | 0.8 |

Thus, crude oil with a high TAN has more (—COO) sites.

In some embodiments of the present disclosure, the intrinsic equilibrium constants in Table 1 may be varied in the SCM to match the measured zeta potentials without the presence of carbonated water. For a given set if intrinsic equilibrium constants, there may be a corresponding zeta potential electrokinetic parameter based on the measured zeta potentials, as previously discussed. The SCM may be performed with another set of intrinsic equilibrium constant values, wherein a predicted zeta potential electrokinetic parameter may vary. This process may be repeated through iterations until the set of intrinsic equilibrium constants in the SCM produces a predicted zeta potential that matches the measured zeta potential. (As used herein, "matching" or "similar" values refers to values that are within +/−0.1% of each other, or other reasonable convergence or tolerance criteria as may be acceptable to the particular variables being compared.)

In some embodiments of the present disclosure, the SCM may iterate the electrokinetic parameters to match the measured zeta potential of the reservoir formation, wherein the underlying formation chemistry and wettability may be determined by the SCM. The kinetic parameters and underlying formation chemistry may be determined by the SCM.

The SCM of a crude oil surface of a given formation may use, for example, the concentration of adsorbed surfaces complexes (i.e., adsorbed ions) to determine the total surface charge using Equation 1:

$$\sigma = \frac{F}{SA}\sum z_i c_i, \qquad \text{Equation (1)}$$

where σ is the surface charge density ($C/m^2$), F is the Faraday constant (96493.5 C/mol), S is the surface material mass (g), A is the specific area ($m^2/g$), $z_i$ is the ionic electric charge, and $c_i$ is the is the adsorbed ion concentration (mol).

The surface charge and surface potential are related through the Gouy-Chapman model, as shown in Equation 2.

$$\sigma = (8000\epsilon_o\epsilon_w RTI)^{1/2}\sinh\left(\frac{vF\Psi}{2RT}\right), \qquad \text{Equation (2)}$$

where $€_o$ is the vacuum permittivity ($c^2/mJ$), $€_w$ is the water relative permittivity, is the surface potential (V), R is the gas constant (J/molK), T is the temperature (K), Ψ is the brine ionic strength (mol/l), and v is the electrolyte ionic charge.

In a formation with calcite, the calcite site density and specific surface area and the crude oil site density and specific surface area may be used for input parameters in Equation 1. Ions adsorbed on calcite surface may be defined by surface reactions in Table 3, the S in Equation 1 (the surface material mass) may be determined based on the number of sites/$nm^2$ for one gram, and A is the specific area for calcite. Similarly, this process may be applied for ions adsorbed on crude-oil surface using crude oil surface parameters and surface reactions (see in Table 1). For example, the site density for a calcite surface is 4.95 sites/$nm^2$, the low TAN crude oil surface has a site density of 0.47 sites/$nm^2$ for both COO— and —N and the high TAN crude oil surface has a site density of 0.6 sites/$nm^2$ for —N and 1.8 sites/$nm^2$ for —COO. In this example, the calcite specific surface area is 1 $m^2/g$, and the crude oil specific surface area is 0.5 $m^2/g$.

The intrinsic equilibrium constants (see Table 1) may be varied in the SCM to match the measured zeta potentials. The varied equilibrium constants may be referred to as fitting parameters. The number of fitting parameters is equal to the number of surface reaction equations. In the example of a crude oil/brine interface, the five surface reaction equations provide five fitting parameters (the five equilibrium constants). In the case of the calcite/brine interface, there are nine surface reaction equations (see Table 3). The nine surface reaction equations of the calcite/brine interface yield nine fitting parameters. The site density and the specific surface area depend on the crude oil composition (e.g., low or high TAN).

TABLE 3

| Calcite Surface Reaction | Equilibrium Constant ($\log_{10} K_{int}$) |
|---|---|
| $>CaOH^{-0.75} + H^+ \leftrightarrow >CaOH_2^{+0.25}$ | 0.4 |
| $>CO_3H^{+0.75} + OH^- \leftrightarrow >CO_3^{-0.25} + H_2O$ | 0.5 |
| $>CaOH^{-0.75} + Ca^{2+} \leftrightarrow >CaOH \ldots Ca^{+1.25}$ | 1.53 |
| $>CaOH^{-0.75} + Mg^{2+} \leftrightarrow >CaOH \ldots Mg^{+1.25}$ | 1.15 |
| $>CO_3H^{+0.75} + SO_4^{2-} \leftrightarrow >CO_3H \ldots SO_4^{-1.25}$ | 1.5 |

TABLE 3-continued

| Calcite Surface Reaction | Equilibrium Constant ($\log_{10} K_{int}$) |
|---|---|
| $>CO_3H^{+0.75} + CO_3^{2-} \leftrightarrow >CO_3H \ldots CO_3^{-1.25}$ | 2.23 |
| $>CO_3H^{+0.75} + HCO_3^{-} \leftrightarrow >CO_3H \ldots HCO_3^{-0.25}$ | 0.09 |
| $>CaOH^{-0.75} + Na^{+} \leftrightarrow >CaOH \ldots Na^{+0.25}$ | 0.22 |
| $>CO_3H^{+0.75} + Cl^{-} \leftrightarrow >CO_3H \ldots Cl^{-0.25}$ | 0.65 |

In embodiments of the present disclosure, the surface reaction equations, as shown in Table 1 and Table 3, may be the same in all instances of crude oil surface reactions (Table 1) and calcite surface reactions (Table 3). The input parameters used in the equations of Table 1 and Table 3 may differ depending on the brine ionic-composition. The brine-ionic composition may be characterized by the individual ion concentrations, as shown in Table 4 for seawater, Smart Water, NaCl, and $Na_2SO_4$.

TABLE 4

| Brine Sample Concentrations (mg/L) | | | | |
|---|---|---|---|---|
| | Seawater | Smart Water | NaCl | $Na_2SO_4$ |
| $Na^+$ | 18,300 | 1,824 | 2,266 | 1,865 |
| $Cl^-$ | 32,200 | 3,220 | 3,495 | — |
| $Ca^{2+}$ | 650 | 65 | — | — |
| $Mg^{2-}$ | 2,110 | 211 | — | — |
| $SO_4^{-2}$ | 4,290 | 429 | — | 3896 |
| $HCO_3^-$ | 120 | — | — | — |
| Total dissolved solids (ppm) | 57,670 | 5,761 | 5,761 | 5,761 |
| Initial pH | 7 | 7 | 7 | 7 |

While the above example is shown in terms of calcite surface reactions and crude oil surface reactions and their corresponding equilibrium constants, one skilled in the art will understand the appropriate equations and corresponding equilibrium constants for a surface complexation model for a wide variety of formations and formation conditions. For example, the equations and equilibrium constants of the models herein may account for other mineral, crude oil, brine, and/or ion compositions.

In embodiments of the present disclosure, step 110 may also include determining the adsorption of brine ions saturated with $CO_2$ at the given reservoir pressure. The adsorption of brine ions saturated with $CO_2$ at the given reservoir pressure may be determined by the solution to the surface complexation model equations, as described above. The solutions to the nonlinear equations may determine the individual adsorbed ions on the calcite and crude oil surfaces based on each specified surface reaction. The equilibrium solution corresponds to a specific zeta potential value. For example, the adsorption of brine ions saturated with $CO_2$ outputs the zeta potential electrokinetic parameters of crude oil/brine and brine/calcite interfaces of the given formation.

It will be understood by those skilled in the art with the benefit of the current disclosure that the equations of the crude oil/brine and calcite/brine ion adsorption for the surface complexation model of embodiments of the current disclosure may be determined by an appropriate computer program, including proprietary and/or specialized software with nonlinear solvers for the surface reaction equations that describe the adsorption of ions based on a specified brine ionic composition. By way of example, the open source software program, PHREEQC, may be used to solve the equations describing the crude oil/brine and brine/calcite ion adsorption. While the equations may be stated by hand, computer programs may be necessary to determine the equations and predict the electrokinetic parameters, such as the surface-charges and the zeta potential.

In embodiments of the present disclosure, reservoir wettability may be described by surface forces, including Van der Waals, electrostatic, and structural forces. Specifically, the magnitude and charge polarity of the calcite/brine and crude oil/brine interfaces may dictate the reservoir wettability for a system comprising carbonated water, oil, and calcite. It is understood by those skilled in the art that a formation possesses a native wettability. In other words, a formation possesses a measurable wettability prior to the application of modifications, such as CWI. The native reservoir wettability may be based on a system comprising original brine, crude oil, and calcite. CWI modifies the native wettability of a reservoir. The modification may be observed through a macroscopic contact angle. The CWI modifies the contact angle as a result of the change in electrokinetics and surface charges of a system. Information on CWI contact angles may be found in "Insights into the wettability alteration of $CO_2$-assisted EOR in carbonate reservoirs" incorporated by reference herein. The zeta potentials of a system are parameters in the electrostatic force component of the contact angles of reservoir wettability.

In embodiments of the present disclosure, the zeta potentials determined in Step 110 of FIG. 1 may allow estimation of reservoir wettability. Embodiments of the present disclosure may determine the ions that may be used to impact surface chemistry and provide insight as to the CWI composition and the impact of CWI on surface chemistry. By adjusting the CWI composition within the model, the wettability may reach a desired value and thus provide a desired composition output via iterative modeling. In embodiments of the present disclosure, and as previously described, the values of the intrinsic equilibrium constants governing the surface reaction equations may be varied and iterated to match measured zeta potentials for crude oil/brine and brine/rock surfaces, and thus validating the SCM. Once the SCM is validated, the injection fluid composition (water salinity, $CO_2$ concentration, etc.) may also be iterated and varied to determine the compositions that may alter the output zeta potential values compatible with the reservoir properties to generate the desired wettability value. In other words, the SCM model may determine injection fluid compositions that may result in altering the zeta potential of the formation, approaching identical zeta potential polarity at both interfaces, such that injection of the determined composition into a formation may result in repulsion, improve the stability of the water film, and provide increased oil recovery.

The equations used to convert the zeta potential values to wettability derive from the Derjaguin-Landau-Verwey-Overbeek (DLVO) theory via the concept of disjoining pressure. The DLVO theory is used to describe the force between charged surfaces interacting through a liquid medium. It consists of the electrostatic repulsion due to the double layer of counterions and van der Waals force. The DLVO uses zeta potential to explain that as two particles approach one another, the ionic atmosphere overlap and develop a repulsion force. The forces, in turn, impact the colloidal stability.

In step 120, the methods of one or more embodiments may involve outputting a wellbore fluid composition with properties determined to extract crude oil from the reservoir formation modelled in step 110. Based on the output wellbore fluid composition, the appropriate components may be mixed, dissolved, or otherwise prepared for injection at the desired rates, mixture proportions, and other desired injection properties. The components may be mixed uphole, downhole, or a combination of uphole and downhole mixing techniques. For example, the components may be mixed uphole inside a pressurized vessel.

Once mixed, the determined composition may be injected into an injection well in the reservoir formation, as shown in step 130. For example, the mixture may be injected downhole at a pressure to maintain a desired bottom-hole pressure and temperature. The components may alternatively be mixed downhole by, for example, injecting the components with $CO_2$ and brine (co-injection), wherein the components may mix downhole before reaching the perforated region. In some embodiments, the injection of the wellbore fluid may be performed at a pressure that is below the fracturing pressure of the formation. In step 140, the crude oil may be displaced from the formation. In step 150, the displaced crude oil may be recovered from the formation. In one or more embodiments, hydrocarbons may be recovered at a production well.

Figure 2:
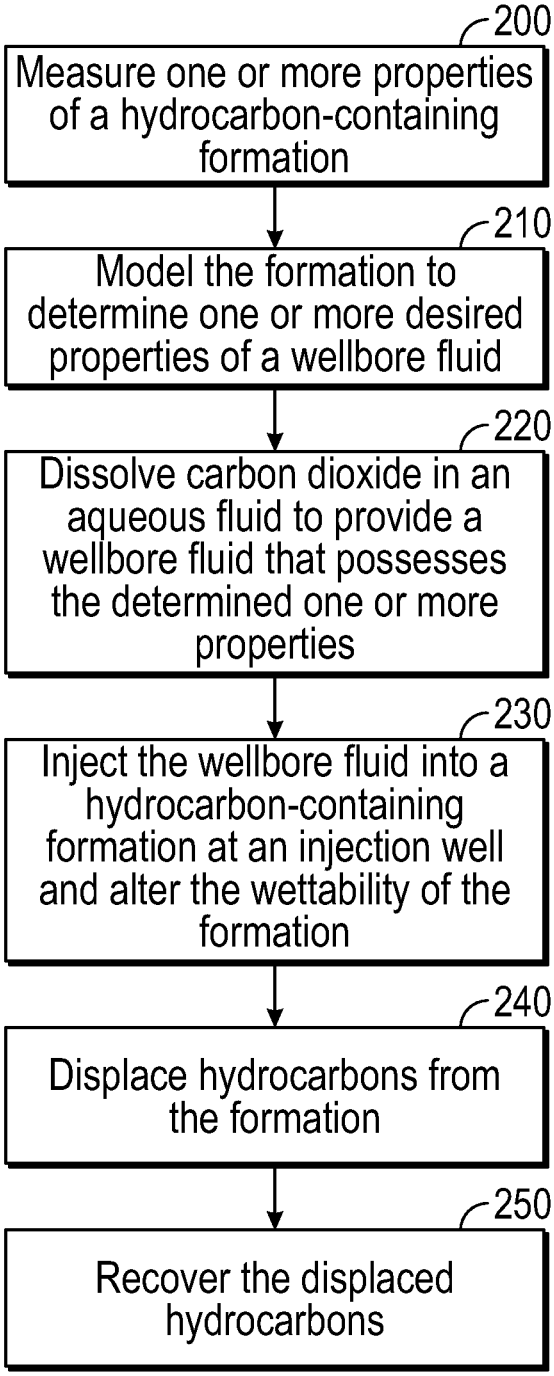
FIG. 2 is a flowchart depicting a method for recovering hydrocarbons by carbonated water injection in accordance with one or more embodiments of the present disclosure.

A method in accordance with one or more embodiments of the present disclosure is depicted by, and discussed with reference to, FIG. 2. The method of one or more embodiments may comprise modeling a reservoir formation to design an injection fluid for a CWI process.

Specifically, in step 200, the methods of one or more embodiments may involve measuring one or more properties of a hydrocarbon formation, as described previously. In particular embodiments, the one or more properties may be selected from the group consisting of the mineral composition of the formation, the formation pressure, the formation temperature, the TAN of the crude oil, and the TBN of the crude oil. As described previously, these properties may be measured by any suitable method known to a person of ordinary skill in the art. The formation of one or more embodiments may comprise calcite and may, for example, be a limestone formation.

In step 210, the methods of one or more embodiments may involve modeling the values measured in step 200 to determine the optimal values of one or more properties of a wellbore fluid to yield efficient hydrocarbon recovery. The modeling operation of step 210 according to some embodiments of the present disclosure may comprise:

(1) Defining the surface reactions described by the surface complexation model for both crude oil and calcite surfaces.

(2) Determining the adsorption of brine ions saturated with $CO_2$ at the given reservoir pressure by determining the zeta potential electrokinetic parameters of the crude oil/brine and calcite/brine interfaces as provided by the surface complexation model equations.

(3) Determining the reservoir wettability for the system comprising of carbonated water/crude oil/calcite, wherein the wettability is based on the magnitude and charge polarity of the calcite/brine and crude oil/brine interfaces.

In the CWI processes of one or more embodiments, the wellbore fluid may comprise $CO_2$ dissolved in an aqueous fluid.

The modelled properties of one or more embodiments may include one or more of the aqueous fluid composition and the surface dissolution pressure of the $CO_2$. These properties may be selected so as to provide a desired reservoir wettability for a given application. The properties may be simulated by an electrokinetic model that allows prediction of the fluid-fluid and fluid-rock interactions to understand the variance in reservoir wettability.

The modeling of one or more embodiments may comprise determining the surface charges and the corresponding zeta potentials of the rock/wellbore fluid and oil/wellbore fluid interfaces. In some embodiments this may provide insight regarding the electrokinetic and wettability properties of the wellbore fluid composition. In some embodiments, the affinity of different ion types may be determined through exploring surface chemistry reactions. In some embodiments, the formation pressure may determine the solubility of $CO_2$ solubility in brine, ultimately affecting the pH level and surface charges.

In step 220, the methods of one or more embodiments may involve providing a wellbore fluid composition that possesses the optimal values of one or more properties determined in step 210.

In embodiments of the present disclosure, a wellbore fluid with the desired composition may be produced based on the values determined by the formation model including a wellbore fluid with the desired salinity and $CO_2$ partial pressure.

In step 230, the wellbore fluid may be injected into the hydrocarbon-bearing formation at an injection well. In some embodiments, the injection of the wellbore fluid may be performed at a pressure that is below the fracturing pressure of the formation. In step 240, hydrocarbons may be displaced from the formation. In step 250, the displaced hydrocarbons may be recovered from the formation. In one or more embodiments, the hydrocarbons may be recovered at a production well.

Overall, embodiments of the present disclosure may provide a robust and accurate model of a reservoir formation, from which a composition and chemistry of an CWI injection fluid may be determined. The composition and chemistry of the injection fluid may be best suited to mobilize the crude oil when injected into the reservoir formation because it is based on the robust and accurate model of the reservoir formation. The SCM of the present disclosure may use lab-measurement data (e.g., zeta potentials of the conditions similar to the reservoir), field measurement data (e.g., reservoir temperature and pressure), and iterations of the electrokinetic parameters until they match the measured zeta potentials. The iteration process of embodiments of the present disclosure may generate a model with accurate underlying chemistry and wettability of the modeled formation. Once an accurate model of the formation is determined, the injection fluid chemistry and composition may also be determined based on the formation model.

It will be understood by those skilled in the art with the benefit of the present disclosure that for a given minerology of a reservoir formation, the corresponding mineral surface reaction equations may be used in modeling the conditions in the given formation, particularly for SCM. For example, sandstone formations may comprise quartz, clay, and carbonates. An SCM may take into account the surface reaction equations for each mineral/brine surface equation present in the sandstone. While different formation mineralogies comprise corresponding mineral/brine ionic interactions, the crude oil/brine (and its dependence on TAN) interactions does not change with the varying formation mineral compositions. Only the zeta potential corresponding to the mineral/brine changes with different mineral reservoir formation models.

EOR has been shown effective in increasing hydrocarbon recovery from reservoirs. EOR methods include thermal methods such as steam stimulation, chemical methods such as surfactant-polymer injection, and miscible displacement methods such as CWI. CWI is an effective EOR method due, in part, to the properties of $CO_2$. $CO_2$ improves oil recovery by lowering interfacial tension, swelling the oil, reducing oil viscosity, and by mobilizing the lighter components of the oil. Injected $CO_2$ may become miscible or remain immiscible with oil, depending on reservoir pressure, temperature, and oil properties. While direct $CO_2$ injection may be used in some reservoirs, alternative $CO_2$ injection strategies, such as CWI, may be considered for EOR operations, particularly in areas of limited $CO_2$ supply.

In CWI, $CO_2$ exists in carbonated water as a dissolved phase and not free phase, eliminating issues around $CO_2$ injections such as gravity segregation and poor sweep efficiency. The dissolution of $CO_2$ in water may also increase water viscosity and density, thereby reducing the gravity segregation and channeling effect. The amount of dissolved $CO_2$ is a useful factor to consider in CWI because it directly affects the data variation, resulting in its application efficiency, thus the solubility of $CO_2$ in water, brine, and oil (i.e., crude oil) should be considered when designing a CWI operation. In CWI, $CO_2$ may be dissolved in water and then injected into the reservoirs. In other words, CWI may be considered as an immiscible injection which includes the advantage of $CO_2$ diffusion from carbonated water to oil (with respect to the higher solubility of $CO_2$ in oil compared to water). The oil phase becomes lighter as the partitioning mechanism occurs with an increase in the carbonated water/crude oil contact time.

The conventional models employed to generate the mechanisms involved in CWI reveal discrepancies between the experimental data and simulation models at certain operating conditions, including parameters wherein water-salinity, pressure, and crude oil composition impact the EOR process.

The embodiments of the present disclosure may generate a model wherein the alteration of a reservoir wettability observed during the CWI process may be fully understood. The model created by embodiments of the present disclosure may account for the electrokinetic effects of water salinity, reservoir pressure, and crude oil in the alteration of reservoir wettability mechanisms present in CWI. These models produced by embodiments of the present disclosure may assist in defining the optimal CWI parameters, such as the properties, including the composition, of a wellbore fluid. The models may also assist in the intermediate calculation results, including the zeta potentials and equilibrium constants.

EXAMPLE

The following example is merely illustrative and should not be interpreted as limiting the scope of the present disclosure.

Figure 3:
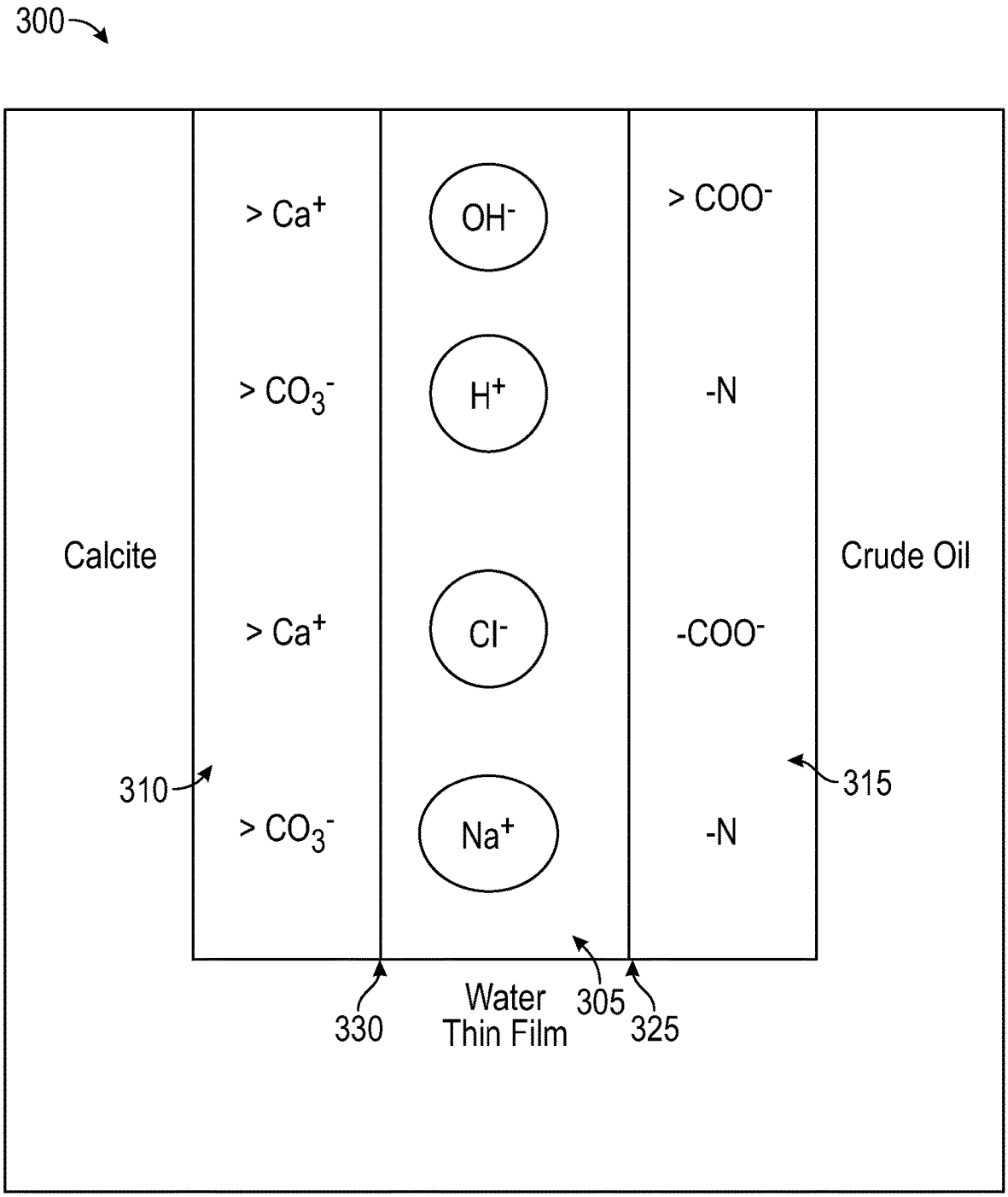
FIG. 3 is a schematic representation of a water layer between a calcite surface and a crude oil surface.

FIG. 3 depicts a calcite/brine/crude oil system 300 of a reservoir, wherein a thin-film layer of water 305 is sandwiched between a calcite surface 310 and a crude oil surface 315. The thin-film layer of water 305 is a brine that includes dissolved ions 320 corresponding to a specific water composition. The thin-film layer of water 305 may have one of the four ionic compositions shown by Table 4, and the crude oil is one of two compositions, which have the total acid number (TAN) and total base number (TBN) properties shown in Table 2.

Crude Oil

The surface complexation model (SCM) was used to describe the equilibrium state of ion adsorption within the water layer, based on specified surface reaction equations that govern the adsorption process on mineral and crude oil surfaces. For the calcite/brine/crude oil system 300 shown in FIG. 3, the adsorption of ions at the crude oil/brine interface 325 and calcite/brine interface 330 determine the corresponding surface charges and zeta potentials, providing insights regarding the electrokinetic and wettability properties of various brine compositions.

Figure 4:
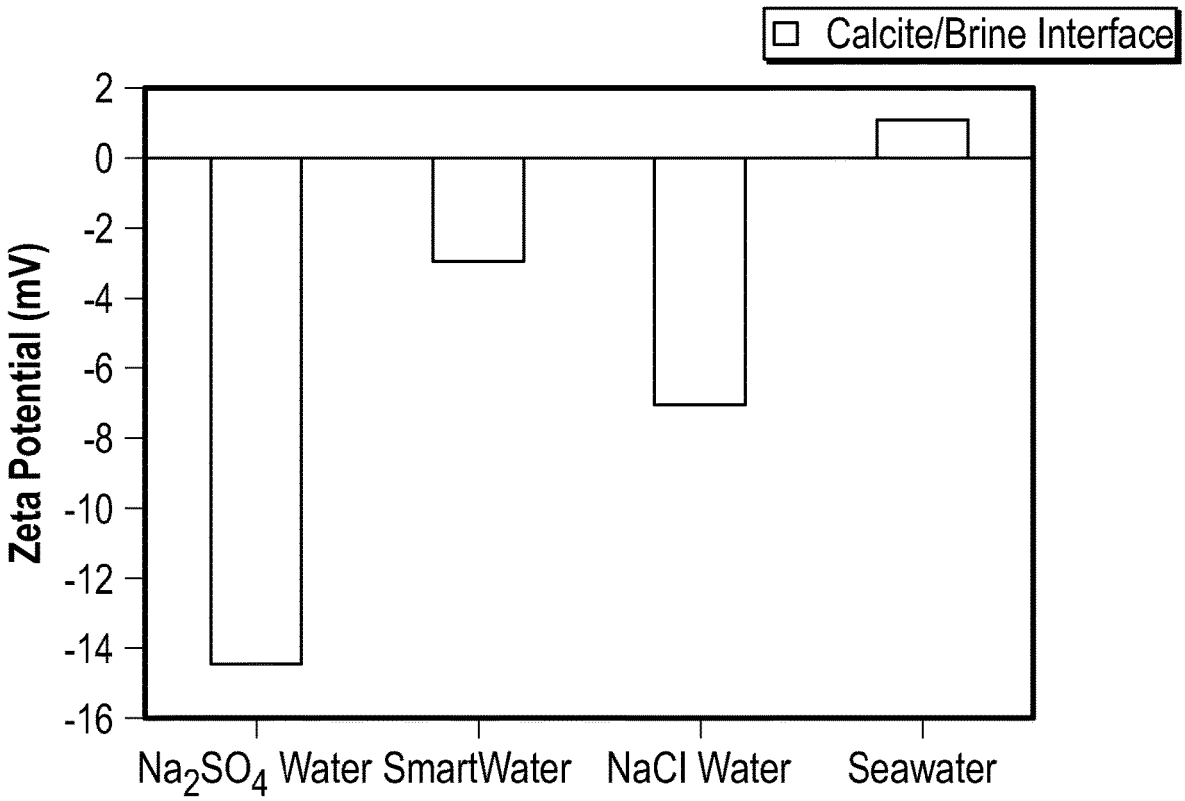
FIG. 4 is a graphical representation of zeta potential values for various water compositions at the calcite/brine interface.

The affinity of different ion types is determined through surface chemistry reactions describing the calcite and crude oil surfaces. The SCM zeta potential values for both brine/calcite and oil/brine at pressures ranging from 0 to 3000 psi are shown in FIG. 4 (calcite/brine interface at atmospheric pressure), FIG. 5 (calcite/brine interface at 1000 psi), FIG. 6 (calcite/brine interface at 3000 psi), FIG. 7 (crude oil/brine interface at atmospheric pressure), FIG. 8 (crude oil/brine interface at 1000 psi), and FIG. 9 (crude oil/brine interface at 3000 psi) show. The pressure determines the thermodynamics of $CO_2$ solubility in brine, which, in turn, affects the pH level and surface charges of the brine.

Figure 5:
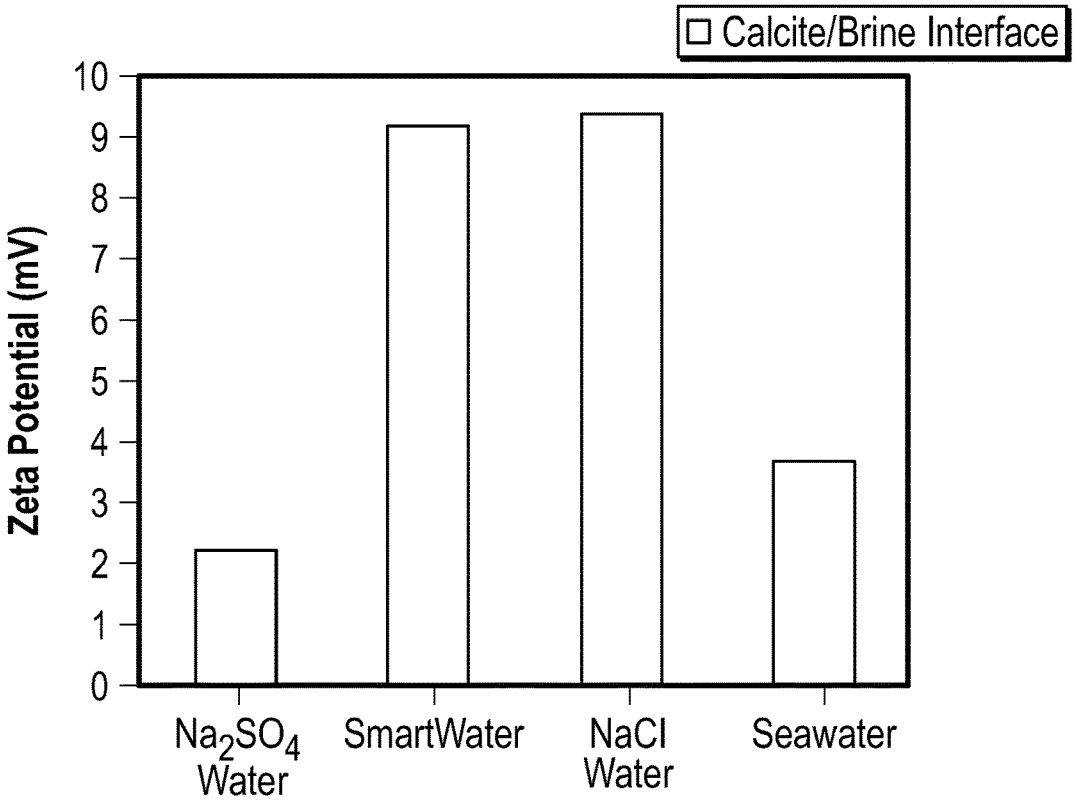
FIG. 5 is a graphical representation of zeta potential values for various water compositions at the calcite/brine interface at a pressure of 1000 psi.
Figure 6:
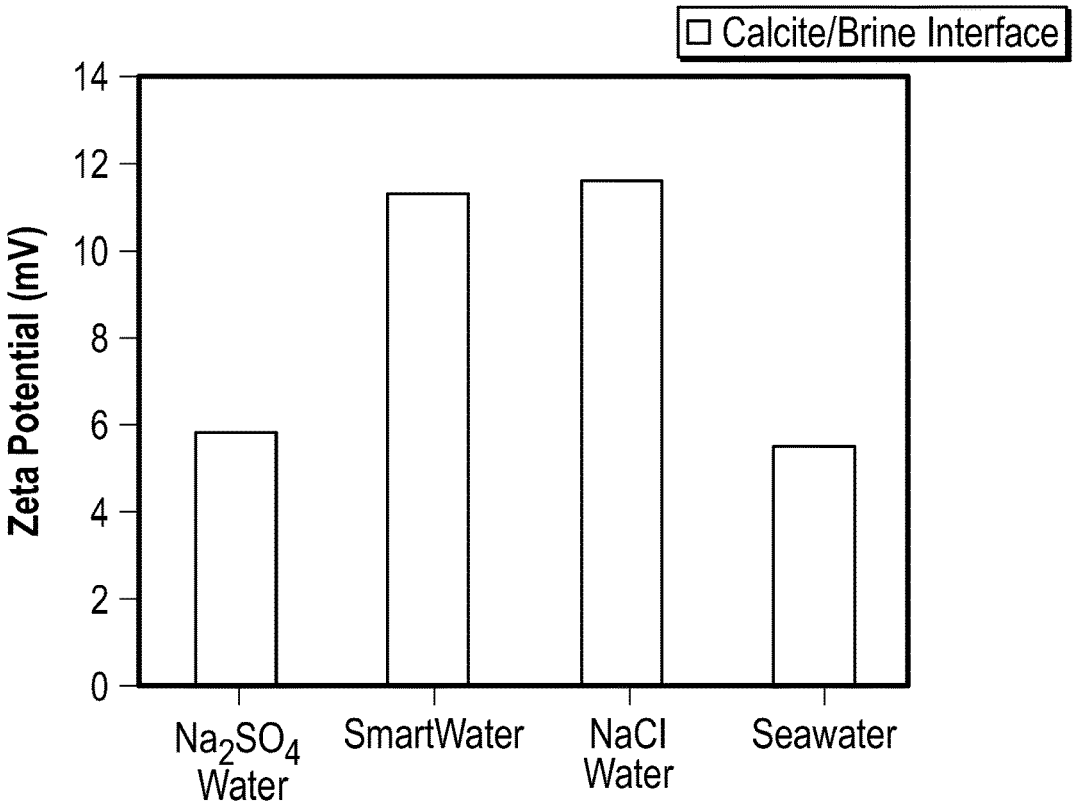
FIG. 6 is a graphical representation of zeta potential values for various water compositions at the calcite/brine interface at a pressure of 3000 psi.

Under atmospheric pressure, the brine/calcite surface charge is negative for the considered brine recipes except for seawater, as illustrated in FIG. 4. The amount of dissolved $CO_2$ in brine is negligible, and the pH level stabilizes around 7. As is shown in FIG. 5, when the pressure is increased to 1000 psi, $CO_2$ becomes more soluble in brine, causing the pH level to lower to about 6, and altering the brine/calcite surface charges to be positive. Upon increasing the pressure to 3000 psi, which is relevant to typical formation pressures, the magnitude of the positive charge is increased even further, as shown by FIG. 4. The pH level stabilizes at around 5 and leads to the dissolution of calcite in the brine.

Figure 7:
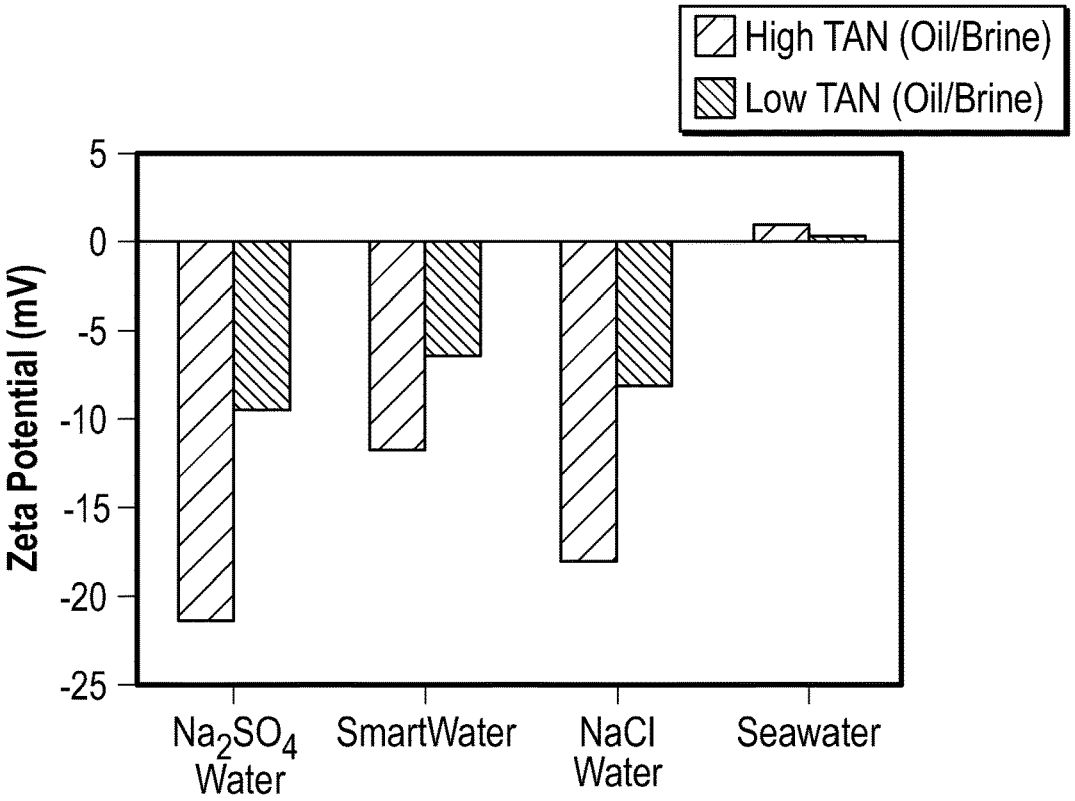
FIG. 7 is a graphical representation of zeta potential values for various water compositions at the crude oil/brine interface.
Figure 8:
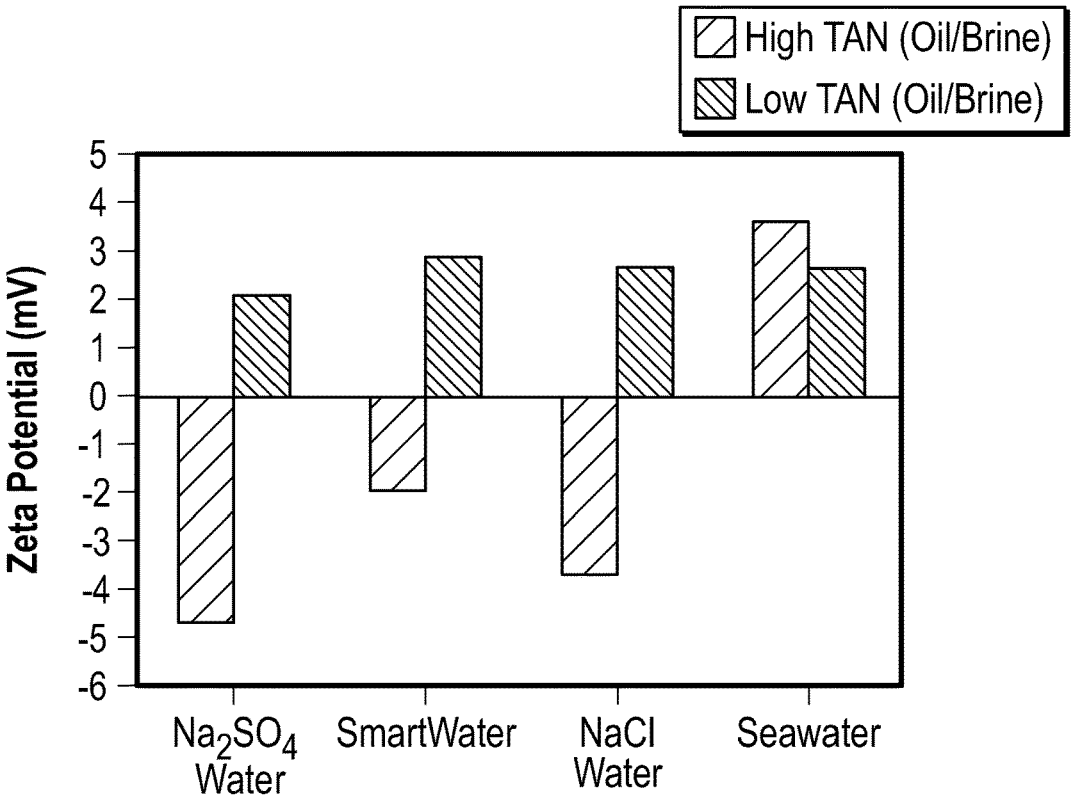
FIG. 8 is a graphical representation of zeta potential values for various water compositions at the crude oil/brine interface at a pressure of 1000 psi.
Figure 9:
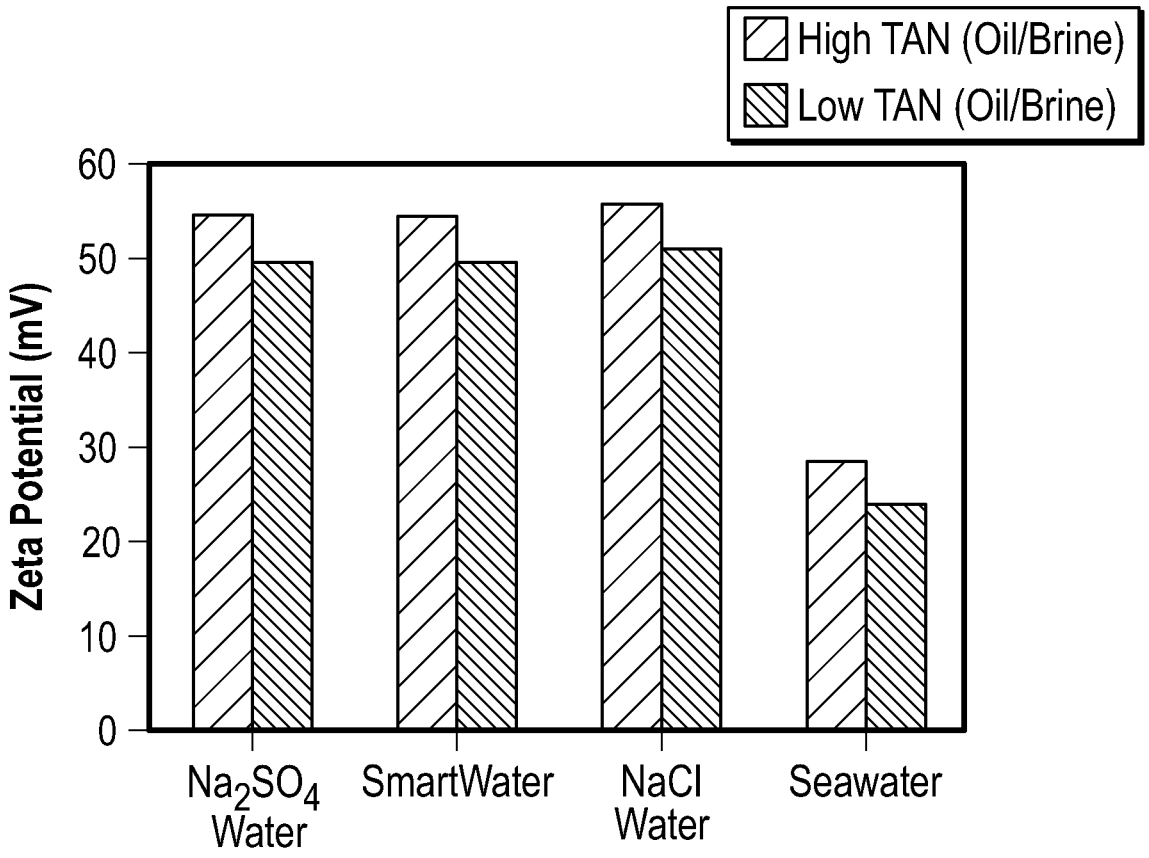
FIG. 9 is a graphical representation of zeta potential values for various water compositions at the crude oil/brine interface at a pressure of 3000 psi.

As is shown in FIG. 7, at the crude oil/brine interface the surface charges are mainly negative due to the carboxylate groups contained by the crude-oil compositions (for both high and low TAN). As the pressure is increased to 1000 psi, the $CO_2$ is dissolved and the pH level is lowered to about 5. In the case of low TAN crude oil type, the brine/crude oil surface charge switches to positive as carboxylate and nitrogen groups become protonated with hydrogen ions. However, the high TAN crude oil maintains a negative surface charge at this medium pressure value, which is illustrated in FIG. 8. As the pressure is increased to 3000 psi, both surfaces of crude oil types become positively charged as shown in FIG. 9, and the pH level stabilizes at around 3.

At a high reservoir pressure, where the brine is saturated with $CO_2$, both calcite/brine and oil/brine surface charges become positively charged, thereby creating an electric repulsion force that stabilizes the water film sandwiched between the calcite and oil surfaces illustrated previously in FIG. 3. Therefore, injecting carbonated water can effectively alter the reservoir wettability if the surface $CO_2$ dissolution pressure is maintained high enough (in other words, a high reservoir pressure) to dissolve large amounts of $CO_2$ and manipulate the surface charges of calcite and oil to become positive. As the crude oil TAN becomes lower, the charge alteration becomes easier to achieve.

In some embodiments of the present disclosure, a CWI formulation for a given crude oil and mineralogical properties may be provided to produce a target wettability. The model according to embodiments of the present disclosure may be used to solve for the types and concentrations of ions in the CWI given a tested mineral and crude oil. In other words, embodiments of the present disclosure may design a CWI formulation to use in a formation to reach a desired wettability value. Thus, the model may be used as a screening tool to suggest a CWI formulation for a given crude oil and mineralogical properties to reach the desired wettability.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for recovering hydrocarbons from a hydrocarbon-containing formation, the method comprising:

determining a pressure of the hydrocarbon-containing formation from one or both of field measurements and reservoir characterization;

determining a temperature of the hydrocarbon-containing formation from one or both of field measurements and reservoir characterization;

determining one or more properties of the formation, where the properties are selected from a group consisting of total acid number of the hydrocarbons, total base number of the hydrocarbons, rock type, and brine ionic composition;

determining a desired amount of wettability alteration of the formation;

modeling the formation using a surface complexation model based on the determined pressure, temperature, and one or more properties to output an estimated wellbore fluid composition, wherein the estimated wellbore fluid composition provides the desired amount of wettability alteration of the formation;

preparing an aqueous wellbore fluid based on the estimated wellbore fluid composition; and injecting the aqueous wellbore fluid into a formation.

2. The method of claim 1, wherein determining the hydrocarbon-containing formation pressure comprises measuring the hydrocarbon-containing formation pressure.

3. The method of claim 1, wherein determining the hydrocarbon-containing formation temperature comprises measuring the hydrocarbon-containing formation temperature.

4. The method of claim 1, wherein determining the hydrocarbon-containing formation pressure comprises estimating the hydrocarbon-containing formation pressure.

5. The method of claim 1, wherein determining the hydrocarbon-containing formation temperature comprises estimating the hydrocarbon-containing formation temperature.

6. The method of claim 1, wherein the modeling comprises:

determining equilibrium constants of a crude oil/brine surface reaction and a brine/rock surface reaction based on the determined formation pressure, formation temperature, and the one or more properties of the formation using surface complexation modeling.

7. The method of claim 6, wherein the modeling further comprises:

using the determined equilibrium constants, iteratively determining the estimated wellbore fluid composition that provides the desired amount of wettability alteration of the formation.

8. The method of claim 7, wherein the iteratively determining the estimated wellbore fluid composition comprises:

iterating an injection fluid composition to determine an injection fluid composition that provides a zeta potential polarity within 0.1% at the brine/rock interface and the crude oil/brine interface.

* * * * *